United States Patent [19]

Stewart et al.

[11] 4,137,595

[45] Feb. 6, 1979

[54] ROTARY TOOL FOR STRIPPING ADHESIVE CARPETING FROM FLOORING

[76] Inventors: George L. Stewart, 600 NW. 195th Ter.; Robert L. Howell, 17131 NW. 9th Pl., both of Miami, Fla. 33169

[21] Appl. No.: 848,507

[22] Filed: Nov. 4, 1977

[51] Int. Cl.[2] ..... A47L 11/00

[52] U.S. Cl. ..... 15/200; 15/93 R; 15/236 C

[58] Field of Search ..... 15/93 R, 198, 200, 236 C; 29/81 J, DIG. 7; 299/41, 89, 90, 91, 93; 51/177

[56] References Cited

U.S. PATENT DOCUMENTS

| | | | |
|---|---|---|---|
| 1,048,233 | 12/1912 | Tideman | 15/93 R X |
| 1,391,882 | 9/1921 | Dworniczak | 15/93 R |
| 1,829,531 | 10/1931 | Neilsen | 15/93 R X |
| 2,113,742 | 4/1938 | Phelps et al. | 15/200 X |
| 2,504,643 | 4/1950 | Burgoon | 15/93 R |

*Primary Examiner*—Edward L. Roberts
*Attorney, Agent, or Firm*—Ernest H. Schmidt

[57] ABSTRACT

A rotary adhesive carpeting removal tool has a circular base support member adapted to be coupled to a rotary drive floor finishing machine, against the underside of which base support member is removably secured a circular clamping member carrying a plurality of replaceable hardened nails projecting outwardly of the underside thereof and operative to shreddingly engage and thereby strip cemented-in-place carpeting from hard floor surfaces.

8 Claims, 5 Drawing Figures

ROTARY TOOL FOR STRIPPING ADHESIVE CARPETING FROM FLOORING

Our invention relates to cemented-in-place carpeting and is directed particularly to a rotary, power-driven tool for quickly removing such carpeting from hard floor surfaces.

Cushion-backed, heavy-duty carpeting is commonly used in commercial installations, such as in department stores, hotels, office and institutional buildings, and in other places where there is heavy pedestrian traffic. In such installations the carpeting is cemented directly to the floor to be covered, which is usually of hard wood or finished cement, by a suitable mastic or adhesive. The removal for replacement of such adhesive carpeting has heretofore been done with the use of solvents and scraping tools of one kind or another forced between the carpeting and the flooring. Such removal tools and methods have been found to be tedious and time consuming and, all in all, to constitute the greater part of the expense and time consumed in the replacement of the carpeting. When large floor areas are involved, such as in department stores for example, the time required with use of such methods would not infrequently necessitate closure of the store to the public during one or more business days in addition to weekend days during which the store would normally be closed. It is, accordingly, the principal object of our invention is to provide a novel and improved tool for removing cemented-in-place or adhesive carpeting within a fraction of the time required by the of the use of methods and tools heretofore employed.

A more particular object of our invention is to provide a power driven rotary tool for removing adhesive carpeting wherein a large number of hard nails extend outwardly of the underside thereof in a symmetrical pattern about the axis of rotation, the outer ends of the nails being adapted to puncture and rippingly engage the exposed cushion backing of the carpeting to be removed so that it is progressively stripped away from the flooring in shreds as the driving machine is guided back and forth along the floor.

Another object of our invention is to provide an adhesive carpeting removal tool of the character described which utilizes ordinary cut nails or masonary nails as the ripping elements, which can readily be replaced at small expense after being worn down from long use.

Still another object of our invention is to provide a rotary adhesive carpeting stripping tool of the above nature which can be drivingly coupled for use with an ordinary heavy duty, rotary type floor finishing machine.

Other objects of the invention will be apparent from the following description when read with reference to the accompanying drawings. In the drawings, wherein like reference numerals denote corresponding parts throughout the several views.

Figure 1:
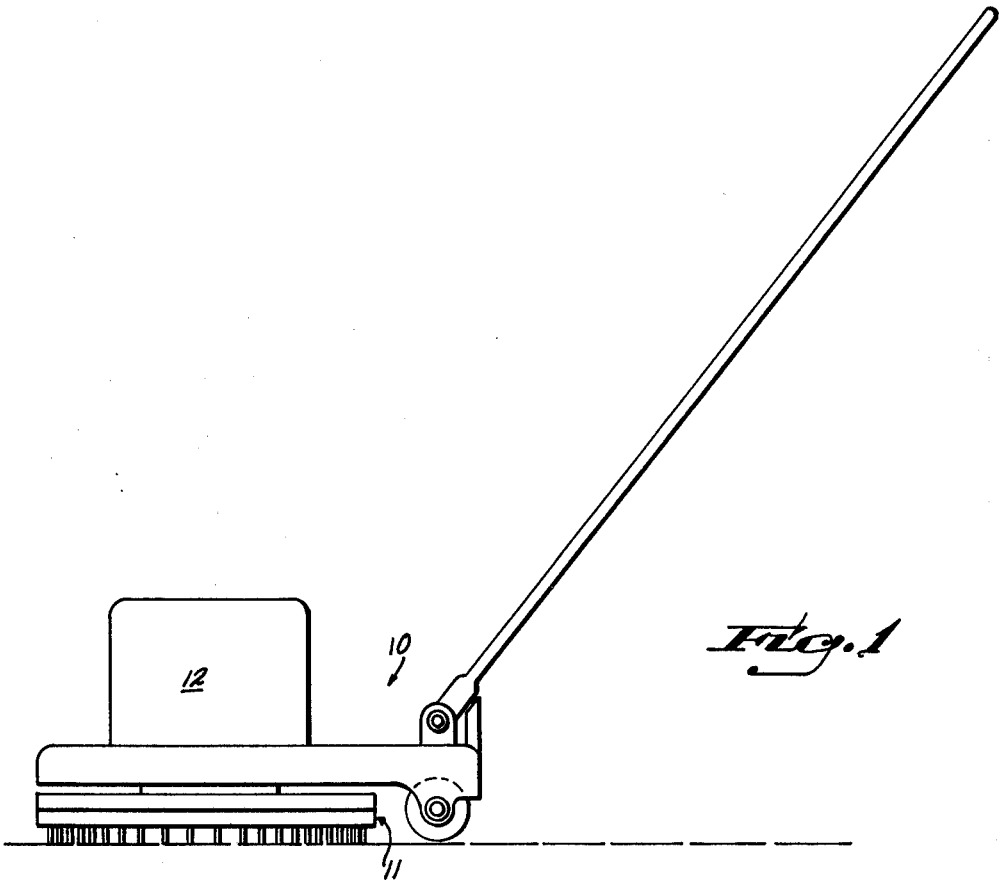
FIG. 1 is a side elevational view of a rotary drive machine equipped with a rotary stripping tool embodying my invention.

Referring now in detail to the drawings, reference numeral 10 designates, generally, an electric rotary drive machine of the type commonly used for floor sanding, waxing or grinding, equipped with a rotary stripping tool 11 embodying my invention. Since the construction and operation of such rotary drive floor machines is known, the details thereof are not further described herein other than to note that the drive motor 12 has a vertically downwardly-extending drive shaft terminating in a coupling member (not illustrated) releasably engagable with a rotary tool of one kind or another for performing work on floor surfaces.

Figure 2:
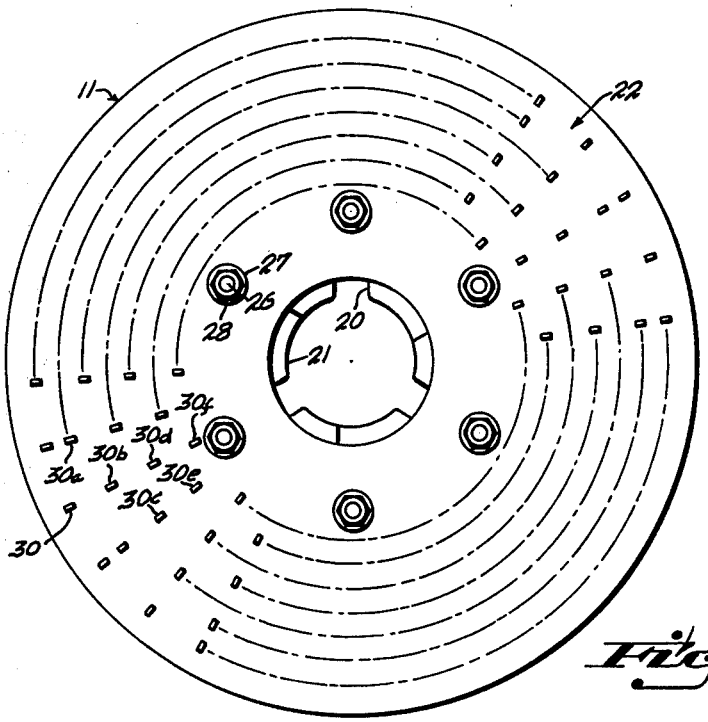
FIG. 2 is a bottom view of the rotary stripping tool, shown separately and on an enlarged scale.
Figure 3:
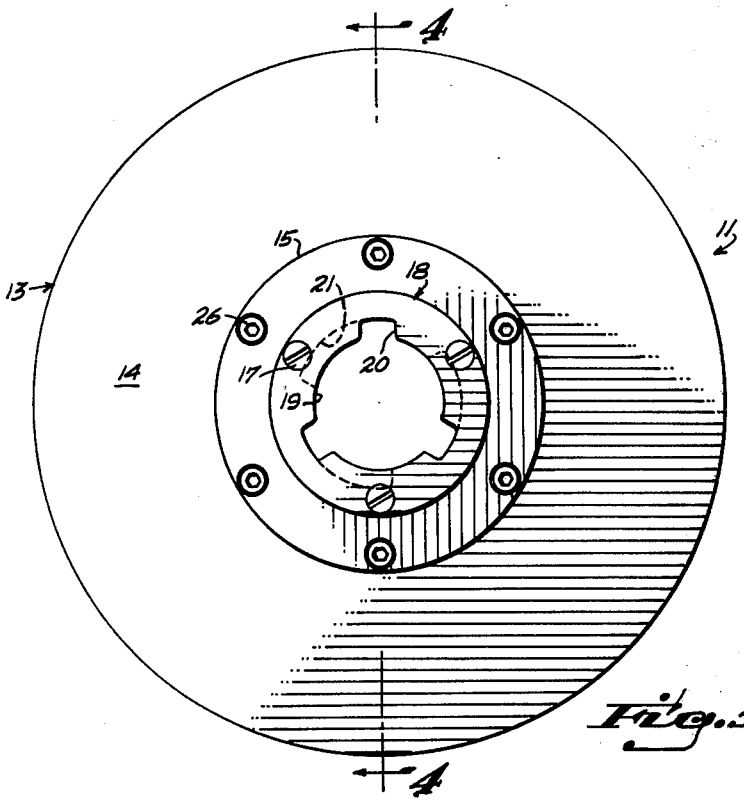
FIG. 3 is a top view thereof.
Figure 4:
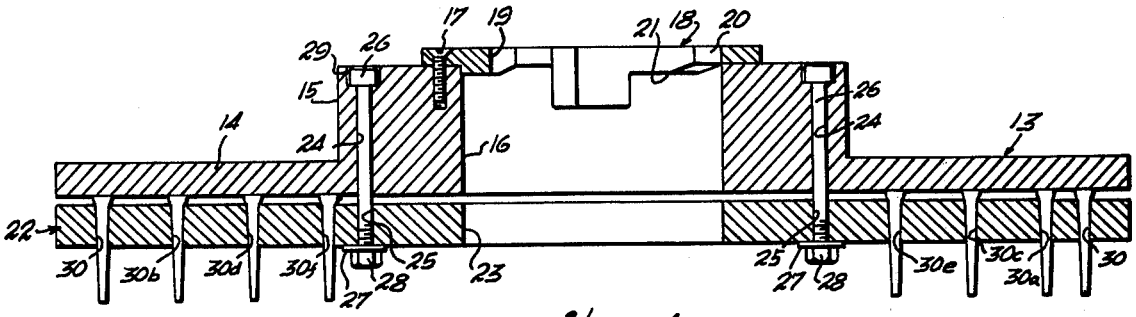
FIG. 4 is a vertical cross-sectional view thereof, taken along the line 4—4 of FIG. 3 in the direction of the arrows and on an enlarged scale.

Referring now to the first embodiment of our invention illustrated in FIGS. 2, 3 and 4, the rotary stripping tool 11 comprises a circular base support member 13, which is preferably integrally formed with an outer peripheral flange portion 14 and a coaxial, reduced-diameter hub portion 15. The hub portion 15 is provided with a concentric through opening 16. Fixed against the upper end of the hub portion 15, as by plurality of machine screws 17, is a metal coupling plate 18 having a central opening 19 formed with radially-extending openings 20 communicating at the underside with respective arcuate slots 21 for reception and interlocking engagement of the rotary drive machine coupling member.

The rotary stripping tool 11 further comprises a disk-like clamp plate 22 having the same outer diameter as that of the base support member flange portion 14 and a central circular opening 23 having the same diameter as that of concentric through opening 16 in the base support member hub portion 15.

Means is provided for clampingly securing the clamp plate 22 in concentric relation against the underside of the base support member 13. To this end, the base support member 13 and the clamp plate 22 are provided with a plurality of pairs of aligned, vertically-extending through openings 24, 25, respectively, said openings extending through hub portion 15 and being circularly equidistantly spaced thereabout. The through opening pairs 24, 25 are adapted to receive attachment bolts 26 for securing the clamp plate 22 in place with the use of washers 27 and nuts 28. Preferably, the through openings 24 in the base support member hub portion 15 will be countersunk at their upper ends, as indicated at 29, for the seating reception therein of the heads of the attachment bolts 26.

A salient feature of my invention by means of which the cemented-in-place carpeting is shredded and thereby efficiently and easily removed from a hard floor surface, resides in the provision of a plurality of ordinary hardened nails or so called "cut nails" projecting outwardly of the underside of the clamp plate 22. To this end, as illustrated in FIGS. 2 and 4, the clamp plate 22 is provided with pluralities of through openings 30, 30*a*, 30*b*, 30*c*, 30*d*, 30*e*, and 30*f*, rotatively spaced along concentric circles of decreasing diameter, respectively, to provide a dense pattern of projection nail ends within a wide annular zone at the underside of the rotary stripping tool 11. The openings 30, 30*a*, etc, will preferably be shaped along their lengths, such as by a swadging operation or the like to conform closely in shape with the hard nails to be fitted therein. In this connection, I have found by practical experience that six-penny cut nails (or hard nails or masonry nails) are most suitable for this application. FIG. 4 illustrates how the nail heads, because of their increased width, project outwardly of the upper surface of the clamp plate 22 and are clamped upon by the undersurface of the base support member outer peripheral flange portion 14 to secure the nails in place.

In use, my rotary stripping tool 11 will be fitted to an ordinary heavy-duty rotary drive machine 10 as described above, and the machine used as one would use an ordinary rotary sanding or grinding tool. The outer fabric layer of the carpeting to be removed will first be cut into wide strips and peeled off by hand to expose the rubber backing. The weight of the machine thereafter supplies sufficient downward pressure on the tool nail ends to rip, strip, and shred the remaining cemented-in-place backing to be removed, quickly and easily. The nail ends readily penetrate the foam rubber or other backing layer of the carpeting and the adhesive or mastic used to cement the carpeting in place, so that the flooring will be entirely stripped, ready for recarpeting or other floor treatment, such as sanding to remove adhesive or mastic, as desired. The removed debris is flung outwardly of the tool so that the floor area being worked upon is always visable. Removal of the carpeting debris by use of push brooms or, where appropriate in large areas, with use of heavy duty vacuuming equipment, quickly completes the job.

Figure 5:
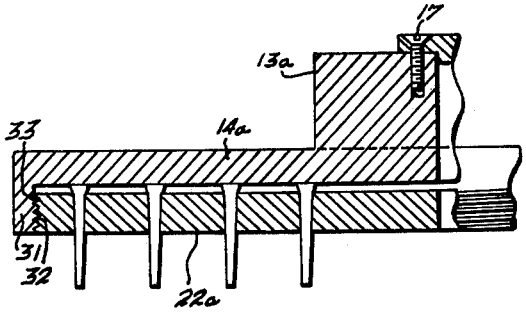
FIG. 5 is a partial vertical cross-sectional view, similar to that of FIG. 4 but illustrating a modification of the invention.

FIG. 5 illustrates a modification of the invention wherein, instead of using attachment bolts 26 to secure the clamp plate 22 with respect to the base support member 13*a* as described above, they are removably secured together by interengaging screw threads. To this end, the peripheral flange portion 14*a* of the base support member 13*a* is integrally formed with a downwardly projecting rim portion 31, which is internally threaded as indicated at 32 in FIG. 5. As further illustrated in FIG. 5, the outer peripheral edge of the clamp plate 22*a* is formed with external threads 33 threadable within the rim portion 31, the interengaging threads extending in the opposite direction to that of the rotative direction of the assembled tool in use so as to tighten rather than loosen the assemblage while in operation. The undersurface of clamp plate 22*a* will preferably be provided with recesses or the like (not illustrated) for the application of impact tools which may be used to rotatively disengage said clamp plate whenever necessary for replacement of the hard nails 30, 30*a*, etc. In this connection, while it is to be understood from the foregoing that the clamp plates can readily be separated from their respective base support members, as described above, for replacement of the hard or cut nails, practical experience has demonstrated that wearing away of the tips of the nails during use of the tool is so gradual that many thousands of square yards of carpeting can be removed from cement flooring, for example, before their replacement becomes necessary.

While we have illustrated and described herein only two forms in which our invention can conveniently be embodied in practice, it is to be understood that these embodiments are presented by way of example only, and not in a limiting sense. Our invention, in brief, comprises all the embodiments and modifications coming within the scope and spirit of the following claims.

What we claim as new and desire to secure by Letters Patent is:

1. A rotary tool for stripping adhesive carpeting from flooring, comprising, in combination, a circular base support member adapted to be drivingly coupled to a rotary drive floor machine, a circular clamp plate, a plurality of axially-extending through openings in said clamp plate, a plurality of flat sided, tapered, hardened, headed nails received through said clamping plate openings with their points extending outwardly of the bottom of said clamp plate, said openings being tapered and of such shape as to conform with the peripheral shape of the shanks of said headed nails received therein, so as to prevent the passage therethrough of the heads of said nails, and means for clamping the top of said clamp plate in coaxial relation with respect to the underside of said circular base support member and against the heads of said headed nails for securing them in place in their clamp plate openings.

2. A rotary tool as defined in claim 1, wherein said clamping means comprises a plurality of bolts extending through aligned openings in said base support member and said clamp plate.

3. A rotary tool as defined in claim 1, wherein said clamping means comprises an internally-threaded rim portion extending downwardly from the outer periphery of said base support member and integrally formed therewith, and external threads formed about the outer peripheral edge of said clamp plate and threadingly engageable with said internal threads.

4. A rotary tool as defined in claim 1, wherein said base support member comprises a peripheral flange portion and a coaxial, reduced-diameter hub portion, said hub portion being provided with a concentric through opening.

5. A rotary tool as defined in claim 4, including a metal coupling plate secured against the upper end of said hub portion and having a central opening coaxial with said hub portion opening for the reception of a rotary drive machine coupling member.

6. A rotary tool as defined in claim 1, wherein said plurality of axially-extending through openings in said clamp plate are rotatively mutually spaced along concentric circles of decreasing diameter, respectively, to provide a pattern of projecting nail ends within a wide annular zone at the underside of said clamp plate.

7. A rotary tool as defined in claim 6, wherein said clamping means comprises a plurality of bolts extending through aligned openings in said base support member and said clamp plate.

8. A rotary tool as defined in claim 6, wherein said clamping means comprises an internally-threaded rim portion extending downwardly from the outer periphery of said base support member and integrally formed therewith, and external threads formed about the outer peripheral edge of said clamp plate and threadingly engageable with said internal threads.

* * * * *